US005219096A

United States Patent [19]

Wing

[11] Patent Number: 5,219,096

[45] Date of Patent: Jun. 15, 1993

[54] LEAKPROOF SELF DEFENSE LIQUID SQUIRT GUN

[76] Inventor: Virgil N. Wing, 3098 N. Acorn Ct., Dale City, Va. 22193

[21] Appl. No.: 870,349

[22] Filed: Apr. 17, 1992

[51] Int. Cl.[5] ..... A63H 3/18

[52] U.S. Cl. ..... 222/79; 222/212; 222/554; 222/48

[58] Field of Search ..... 222/48, 78, 79, 212, 222/548, 554

[56] References Cited

U.S. PATENT DOCUMENTS

| | | | |
|---|---|---|---|
| 563,114 | 6/1896 | Wolff . | |
| 599,383 | 2/1898 | Bunnell et al. | 222/79 |
| 600,552 | 3/1898 | Parker | 222/212 |
| 608,430 | 6/1898 | Humphrey | 222/79 |
| 608,666 | 8/1898 | Garrett | 222/79 |
| 617,495 | 1/1899 | Reimann | 222/79 |
| 688,882 | 12/1901 | Parker | 222/79 |
| 1,994,294 | 3/1935 | Williams | 42/2 |
| 2,629,516 | 2/1953 | Badham | 222/79 |
| 3,084,466 | 4/1963 | Duncan . | |
| 3,512,944 | 5/1970 | Craig et al. | 222/554 X |
| 4,187,960 | 2/1980 | Bonk | 222/212 X |
| 4,402,430 | 9/1983 | Fox et al. | 222/183 |
| 5,000,347 | 3/1991 | Tran | 222/1 |

FOREIGN PATENT DOCUMENTS 16780 of 1896 United Kingdom .

*Primary Examiner*—Gregory L. Huson

[57] ABSTRACT

A squirt gun pistol form to project a protective and disabling fluid as ammonia or jalapena juice wherein the projection force and fluid storage are combined in a collapsible bulb threadedly connected to a leakproof assembly embodying an on-off valve, a valve pointer a liquid channels which are sized to maximize protective fluid range beyond the grasp of a human predator or the teeth of a vicious dog.

2 Claims, 2 Drawing Sheets

LEAKPROOF SELF DEFENSE LIQUID SQUIRT GUN

BACKGROUND-FIELD OF INVENTION

This invention satisfies a 100-year-old search for a definitive defense (especially by women) against human predators or vicious dogs.

BACKGROUND-DESCRIPTION OF PRIOR ART

Predators, human and animal have always existed. The need for a defense has been recognized in the prior art of numerous inventors seeking simple, effective non-lethal weapon designs. Ideally that weapon would be effective beyond the grasp of the predator and sufficiently disabling as to allow for escape time—and if possible, be non-lethal.

Beginning with the most recent of prior art: U.S. Pat. No. 5,000,430 to TRAN, Mar. 9, 1991, a design for projecting a protective vapor from a vapor sprayer, is short ranged, perhaps under three feet, and knowing the pickup tube inefficiency, it requires more than two pump strokes to effect any vapor emission from the sprayer nozzle. This device has time and distance flaws.

A pressurized chemical cartridge as in U.S. Pat. No. 4,402,430 to FOX et al, Sep. 6, 1983 is a pressurized chemical cartridge attached, for masking purposes, on brief case handle or a flashlight, etc. Where a cartridge replacement is required it presupposes that replacement cartridges will be available on the market for reload. The manufacturer would not stock reloads unless or until satisfied with the sales volume of the device. The resupply question also occurs to the potential purchaser.

The lipstick or ballpoint pen as masking device is contemplated for U.S. Pat. No. 3,084,466 to DUNCAN, Apr. 4, 1963, this device launches a lachrymal mixture of choice, (such as red pepper) by firing pin and a "charge" having a percussion cap. However effective the launcher may be, not many men or women are comfortable firing an explosive device in their bare hands.

Prior art predating the above three examples ranges from U.S. Pat. No. 568,114, Jun. 30, 1896 through U.S. Pat. No. 688,882, Dec. 17, 1901, and are ingenious designs for water pistols or squirt guns to the same worthy purpose: Non-lethal self-defense. Those old designs were limited to materials and the manufacturing processes of their period and which would be inordinately expensive today.

OBJECTS AND ADVANTAGES

Accordingly, several objects and advantages of my design follow:

(a) my squirt gun fulfills a social vacuum of need universally recognized. Not only will its use punish predators, but eventually the sight of it will have an effective defense by reputation.

(b) my predator-zapping squirt gun by design ensures readiness: the hole molded into the gun body accomodates a keyring and vulnerability is associated with the automobile: remote parking areas or breakdown on the highway; when it is attached to the automobile keys, one cannot leave home without it.

(c) my gun reload: merely unscrew the bulb and collapse it with the nozzle emmersed in the liquid of choice: ammonia, jalapena juice, lemon juice, etc.; screw the bulb snugly onto the gun body when full. Now ready, it will stop a pitbull or two men.

(d) size, the gun and the one-ounce bulb may be concealed in the average woman's palm.

(e) factors of safety or health: the use of ammonia or other household products as vinegar, jalapena or lemon juice are readily available and pose no hazard between the market, home storage or regular usage. All risks are assumed by the predator when he elects to become a meanace.

(f) my gun design will not break from a fall; the moving lubricated parts have noconceivable wear factor; repair policy will emulate the A. T. Cross Company policy: "All Cross writing instruments . . . are unquestionably guaranteed against mechanical failure, regardless of age. Any Cross product or part requiring service will be replaced or repaired when received at the factory from the consumer."

(g) weight, one fluid ounce is the weightiest part of the working model.

(h) all parts are made from molded plastic with a precision fit, which places the cost of manufacture within the price reach of virtually everyone.

Further objects and advantages of my squirt gun will become apparent from a consideration of the drawings and ensuing description.

DRAWING FIGURES

In the drawings, FIGS. 1 through FIG. 5, show different perspectives and views of the gun parts, both assembled and exploded.

DESCRIPTION OF MY LEAKPROOF SQUIRT GUN

Figure 1:
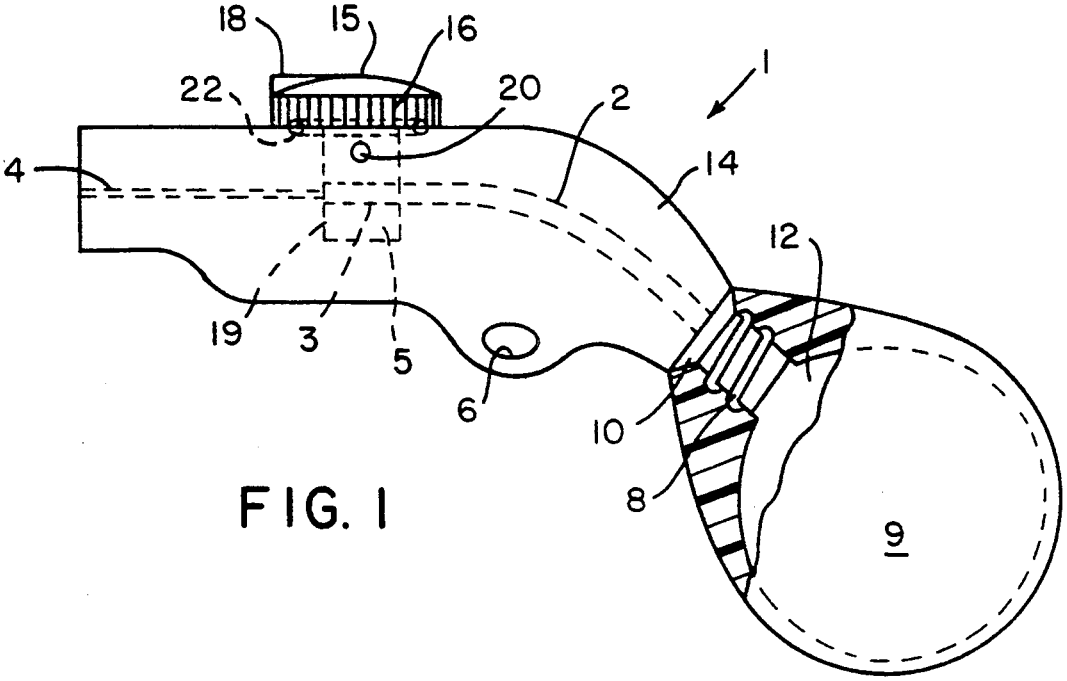
FIG. 1 shows a gun body in profile, interior channels and chamber represented by dotted lines.
Figure 2:
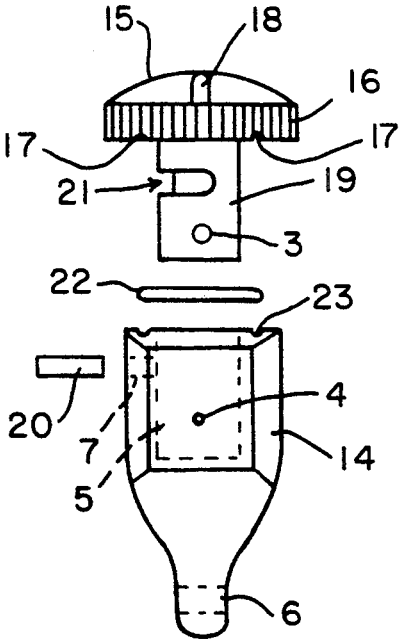
FIG. 2 shows a front end-on view of gun body cylinder valve and o-ring seal. Cylinder valve cavity, guide pin hole and keyring hole are represented by dotted lines; metal pin is represented adjacent to its hole.
Figure 3:
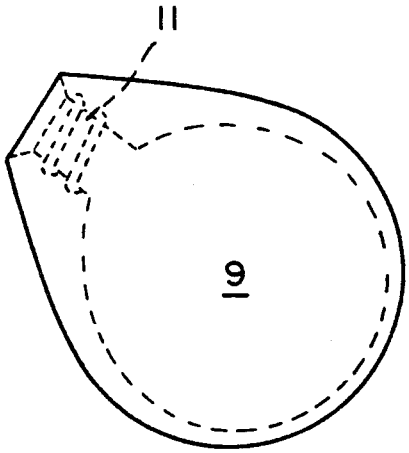
FIG. 3 shows a profile view of the storage-propellant bulb, FIG. 9, with dotted lines representing interior contours and molded female threads.
Figure 4:
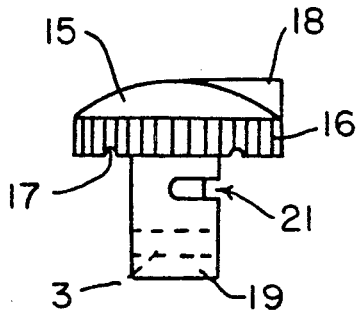
FIG. 4 shows the cylinder valve with a 90-degree slot visible and liquid channel represented by a dotted line in alignment with front end of cylinder valve wheel.
Figure 5:
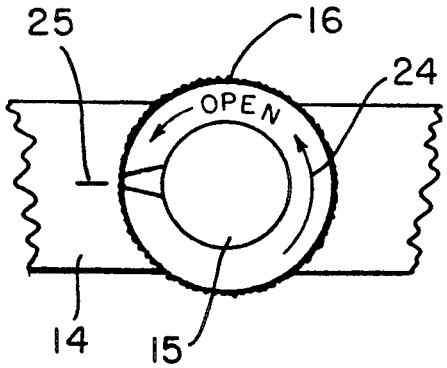
FIG. 5 shows top view of cylinder valve wheel with inscription and an overhang relative to the gun body.

FIG. 1 shows a profile view of my squirt gun, internal channels of a molded plastic gun body are shown in dotted lines from bulb end channel, FIG. 2, through a cylinder valve, FIG. 3, to constricting channel, FIG. 4.

Storage-propellant bulb, FIG. 9, is molded with internal capacity for one liquid ounce, FIG. 12, with molded female threads, FIG. 11, theadedly connected to male threads of gun body, FIG. 8, and with matching seal angles to gun body at FIG. 10, said seal angles providing leak proofing between said bulb and said gun body.

FIG. 15 shows a cylinder valve body, dotted lines, FIG. 19, a through channel, FIG. 3, aligned in open position relative to gun body channels. Said one-piece cylinder valve is comprised of knurled valve wheel, FIG. 16, valve position pointer, FIG. 18, position limiting slot, FIG. 21, and recess for o-ring seal, FIG. 17.

O-ring seal, FIG. 22, is lubricated and seated in recess, FIG. 23 of gun body, and recess, FIG. 17, of cylinder valve wheel.

A metal pin, FIG. 20, is inserted into gun body hole, FIG. 7, to engage position limiting slot, FIG. 21, of of cylinder valve. Engagement of pin, FIG. 20, with the valve body slot, FIG. 21, requires close tolerance in order to effect constant pressure upon the o-ring seal, FIG. 22, seated in recesses, FIG. 17 and FIG. 23; the same pressure doubles in function to exert position control to said valve wheel to maintain position set by operator.

Storage-propellant bulb, FIG. 9, is molded with internal capacity of one fluid ounce, FIG. 12, and with molded female threads, FIG. 11, threadedly connected to male threads of gun body, FIG. 8, and with matching seal angles to gun body at FIG. 10, said seal angle providing leakproofing between said bulb and said gun body.

Operation of My Leakproof Squirt Gun FIGS. 1 to 5

FIG. 1 represents my squirt gun fully assembled.

Familiarization and trials are brief. Practicing with water as the liquid substance to be squirted at random targets need not consume time. After loading and shooting trials the procedure becomes automatically simple, and shooting will be instinctive, even in panic.

To load: prepare a teacup or similarly shallow dish and fill it with the fluid of choice (ammonia is the most effective disabler for it affects both respiration and vision).

a. unscrew bulb, FIG. 9, from gun body, FIG. 14.

b. collapse bulb, FIG. 9, then hold the bulb nozzle well below the fluid surface; released from manual pressure, the bulb will fill with liquid.

c. screw the bulb into place on the gun body, FIG. 14, carefully ensure a snug closure with seal angles, FIG. 10.

d. test turning movement of valve wheel FIG. 15, with the thumb and forefinger grasping the knurled edge, FIG. 16. One ninety-degree movement of the wheel, open to closed, is 10 mm, one finger stroke.

e. squeeze bulb while pointing in the direction of the target until a stream of liquid becomes visible, then if correction is needed, adjust. One load will last 3 to 5 seconds, time enough to make a target correction.

f. keep house and car keys attached to molded keyring loop, FIG. 6, this assures self-defense prepardness: (1) having the gun available, and (2) having it in-hand when most vulnerable to assault. If the keys are in-hand the valve should be in the open position, pointing forward, and ready.

SUMMARY, RAMIFICATIONS AND SCOPE

Accordingly, it will become evident that with the simplicity in use and construction of my squirt gun, plus its devastating effects when and if it is employed, will substantially reduce attacks upon women.

My preferred news headline Jogging Path Attacker Hospitalized After Asphixiation. We are accustomed to: Jogging Path Strangulation—No Suspects.

Ramifications are literally endless: Self-defense has become an imperative. No one believes that a rapist or mugger is deterred by potential capture. Capture often means a sentence to counseling sessions. I submit that the curative powers of a face full of ammonia vapor is more potent than five years with the head doctor.

When the notoriety of the squirt gun begins to grow, the deterrent effect will grow exponentially, so that its very existence will be a deterrent.

The preferred embodiments of this invention are illustrated. The shape may be modified for symetry, a lock-stop may be employed at the gun-bulb connection. Where design imperfections are perceived, visible or invisible, corrections will be adopted, and should not be construed as limiting the scope of the invention.

Thus the scope of the invention should be determined by the appended claims and their legal equivalents, rather than any examples given.

I claim:

1. I claim:

a) a molded gunbody having a cylinder valve chamber medially thereof and a concentric recess thereabout, said gunbody further comprising a liquid channel running through the longitudinal axis of the gunbody the entire length thereof and passing through the cylinder valve chamber at a central location, b) a resilant bulb having attachment means for removable connection to the gunbody at one end thereof, said bulb communicating with said liquid channel, said bulb serving as a reservoir for said liquid;

c) a mushroom shaped valve element received in said cylinder valve chamber and having a liquid channel therethrough, said valve element rotatable so as to selectively place its liquid channel in communication with said gunbody to allow passage of said liquid from the bulb through the valve chamber and out of a terminal outlet;

d) said mushroom shaped valve element comprising a mating concentric recess in the head portion thereof which matches the gunbody recess when the stem portion of the said valve element is received in said cylinder valve chamber;

e) an o-ring within said gunbody and valve stem recess for sealing said cylinder valve chamber;

f) a key receivable through said gunbody and into said valve element to fix the position of one to the other to compress said o-ring.

2. A squirtgun according to claim 1, further comprising, a) wherein said key includes a metallic dowel;

b) wherein said molded gunbody includes an open loop integral to the gunbody;

c) wherein said valve element head includes means for accurately positioning said valve by a sense of touch;

d) wherein said valve element head has serrated edges.

* * * * *